US006193075B1

(12) United States Patent
Plas

(10) Patent No.: US 6,193,075 B1
(45) Date of Patent: Feb. 27, 2001

(54) AIR CLASSIFICATION OF ANIMAL BY-PRODUCTS

(75) Inventor: Stephen Jeffrey Plas, Shawnee, KS (US)

(73) Assignee: Colgate-Palmolive Company, New York, NY (US)

( * ) Notice: Subject to any disclaimer, the term of this patent is extended or adjusted under 35 U.S.C. 154(b) by 238 days.

(21) Appl. No.: 08/723,737

(22) Filed: Sep. 30, 1996

(51) Int. Cl.[7] ..... B04C 5/00
(52) U.S. Cl. ..... 209/715; 209/714; 209/712
(58) Field of Search ..... 209/711, 712, 209/713, 714, 715, 716

(56) References Cited

U.S. PATENT DOCUMENTS

| | | | | |
|---|---|---|---|---|
| 840,301 | * | 1/1907 | Cook | 209/712 |
| 2,236,548 | * | 4/1941 | Prouty | 209/716 |
| 3,434,593 | | 3/1969 | Sullivan | 209/31 |
| 3,590,995 | | 7/1971 | Truckenbrod | 209/140 |
| 3,960,714 | | 6/1976 | Strauss | 209/139 A |
| 4,211,641 | * | 7/1980 | Jager | 209/716 |
| 4,257,880 | | 3/1981 | Jones . | |
| 4,551,241 | * | 11/1985 | Saverse et al. | 209/714 |
| 4,680,107 | | 7/1987 | Manola . | |
| 4,759,943 | | 7/1988 | Ross . | |
| 4,963,634 | | 10/1990 | Di Rienzo . | |

FOREIGN PATENT DOCUMENTS

| | | |
|---|---|---|
| 29 39 809 | 4/1981 | (DE) . |
| 3309518 | 9/1984 | (DE) . |
| 0 155 457 | 9/1985 | (EP) . |
| 0 374 491 | 6/1990 | (EP) . |
| 2396597 | 2/1979 | (FR) . |

OTHER PUBLICATIONS

PCT Search Report.

Dr. O. Lauer & H. Prem, Protein Enrichment in Vetetable Products by Air Classification, Alpine AG, Augsburg, Germany, Special Print 62.

Progressive Industries, Inc., The Micro–Sizer Air Classification System, Sales Brochure and Description (1 page), Progressive Industries, Inc., Sylacauga, AL 35150.

Mikroplex–Spiral Air Classifier MPVI, Sales Brochure, Alpine AG, Augsburg, Germany.

J.M. Coulson, et al., Chemical Engineering 3rd Edition, vol. 2, Pergamon Press, Elmsford, N.Y., 1978, pp. 300–309.

D.W. Green, Editor, Perry's Chemical Engineers' Handbook, 6th Edition, McGraw–Hill Book Company, New York, N.Y., 1984, pp. 20–83 to 89 & 21–31 to 21–33.

* cited by examiner

*Primary Examiner*—Christopher P. Ellis
*Assistant Examiner*—Joe Dillon, Jr.
(74) *Attorney, Agent, or Firm*—Henry S. Goldfine

(57) ABSTRACT

The utilization of an air cyclone classifying method to effectively separate out a low ash fraction, containing less than 11% by weight of non-protein material, from rendered animal meal. A yield of low material greater than 50% by weight is recovered as usable canine and feline food. The method involves the creation in a first cyclone separator of a double vortex air cyclone having a descending external air vortex and a rising internal air spire; wherein an upper chamber therein is equipped with a rotary particle rejector. The rendered animal meal infeed is fed into the rising air spire which entrains and carries the low ash fraction through the rotary particle rejector, to a second cyclone air cleaning device; wherein the low ash material is recovered from the entraining air. The larger and denser high ash particles are recovered from the first cyclone separator.

4 Claims, 1 Drawing Sheet

AIR CLASSIFICATION OF ANIMAL BY-PRODUCTS

FIELD OF THE INVENTION

The present invention relates to the classification of feed made from animal by-products and in particular relates to a method of use of air cyclone separation technology to maximize the recovery of low ash meal therefrom.

BACKGROUND OF THE INVENTION

Animal by-products generated from poultry, ovine, bovine, swine and fish sources having limited market value as human food, typically, heads, feet, bone, horn, feathers, skin, chicken necks and backs, fish frames, certain whole fish and internal organs are cooked in a rendering process to remove both moisture content and fat to create a feed meal suitable for animals. Due to the relative high content of inorganic, non-combustible materials (ash) found in such feed meal, its direct use as a pet food is limited. It is known to those in the field of pet nutrition that excess amounts of minerals, such as calcium and phosphorus in the ash, is detrimental to both canine and feline health. The low ash, high protein fraction which is separated from rendered animal meals is commercially viable as both a canine and a feline feed, when the ash content is less than 11% by weight. Typically, untreated commercially rendered animal meals have an ash content greater than 11% and as much as 28% by weight.

Historically, a series of vibrating screens have been used to separate the denser high ash fraction from the less dense more protein ladened low ash fraction of rendered animal meals. This method has a number of disadvantages. For example, the screens used for the separation classify only by size and as a significant percentage of the high ash particles are close in size to the low ash particles, effective screen separation is difficult. Also, high ash bone splinters having narrow cross-sections tend to pass through the screens, with the desired low ash particles. In practice, vibrating screening of rendered animal meals normally provides a relatively low yield, e.g., 10 to 20% by weight of low ash material out of the rendered animal meal. Further, vibrating screens are relatively costly, energy intensive and frequently require recycling through several screens of varying size to provide their low yield of low ash material.

Another method known to the art for recovering the low ash fraction of rendered animal meal is discussed in U.S. Pat. No. 4,759,943. This patent teaches an air separation method wherein a strewing plate imparts tangential motion to the infeed stream of rendered animal meal, proximate to the streams entry of into the air classifier. An internal fan positioned coaxial to and mounted directly below the strewing plate, creates a counter-current air stream which entrains and carries away the desired lighter, lower density, low ash containing fines, from the more heavy, denser, undesired high ash fraction, to effect the separation. The denser high ash fraction is entrained in an air stream at the periphery of the air separator, where it is carried by the momentum imparted by the strewing plate, and wherefrom it falls by gravity to a first exit. The lower ash segment entrained in the counter-current air stream is directed to an internal channel, from which it is discharged from a second exit. The air separation method disclosed in U.S. Pat. No. 4,759,943, although more energy efficient than the vibrating screen separation method hereinbefore discussed, is still limited from a yield perspective, yields of about 33% by weight of the low ash fraction from the animal meal infeed being typical.

The present invention recovers the low ash component from rendered animal meals by using an adaptation of a dynamic air cyclone separator to avoid the drawbacks of the prior art hereinbefore discussed. The dynamic air cyclone separator has been used by the prior art to separate valuable minerals from waste gangue. Such mineral separation involves the classification of high density media that had been processed into fine 0.04 to 0.0005 meter particles (1.5 inch diameter to 28 mesh). In use, air is introduced tangentially into the separator housing at velocities of approximately 30 meters/second. The separator housing is formed of an upper cylindrical chamber provided with an upper air outlet and a lower conical section with a bottom material outlet. The rapid tangential inflow of the air creates a double vortex cyclone. The double vortex cyclone includes a first axially downward spiraling air flow along the outer walls of the cylindrical and conical sections to the lower outlet. Simultaneously, a second air flow spirals axially upward through the housing's center to the upper air outlet, the second air flow having a narrow diameter typically about 0.4 times that of the upper air outlet.

Cyclone separators have also been used for the separation of vegetable meals. The density differential between the desired protein fractions and non-protein fractions in vegetable meals is quite large, whereby a fraction having double the protein content of the untreated, infeed vegetable meal, mixture can be isolated. This method of air classification can be used to increase the protein content of meals made from such vegetable by-products as wheat flour, bean powders, and seed kernels. In this method, the mineral particles or vegetable meal is subjected to two opposing forces in the radial direction, laterally toward an outer wall of the separator. The first force is the centrifugal force of the downward vortex, which tends to throw the particle toward the outer wall and therefrom downward to be discharged through a bottom outlet. The second force is the drag of the air and eddy currents which tend to carry the particle to the central, axially upwardly, moving central spiral of air, whereby it is discharged through an upper air outlet. The movement of the particle, outwardly and down or inwardly and up, depends on the mass, density, configuration and size of the particle being acted on, as well as, the configuration of the separator, and the infeed vector and velocity of the air; all elements defining the tangential, radial and axial components of the velocity vectors acting on the particle. The degree of separation achieved by such prior art cyclone separators is primarily a function of the difference in particle size; such separators can be effective when substantial differences exist in the size and densities of the materials being classified.

For example, U.S. Pat. No. 4,257,880 discloses a primary cyclone separator which includes an upper cylindrical section and a lower conical section. The upper cylindrical section having a spinning vertical blade rotary rejector suspended from its top. Classifying air ladened with generally smaller, less dense, particles that have passed through the rotary rejector and exited from an upper air outlet in the primary cyclone separator are directed to a secondary cyclone separator. This secondary cyclone separator classifies the smaller, less dense, particles from the entraining air from which they are recovered. A fan loop recycles the air, from which the particles have been separated, from the secondary cyclone separator, at superatmospheric pressure back to the lower conical section of the primary air cyclone separator.

U.S. Pat. No. 4,963,634, discloses the use of a cyclone separator of the type disclosed in U.S. Pat. No. 4,257,880 for the preparation of polyvinyl chloride resins substantially free of fine-sized particles. U.S. Pat. No. 4,963,634 discloses that the degree of separation possible using the cyclone air separator of U.S. Pat. No. 4,257,880 is primarily governed by the air flow rate into the primary cyclone separator, the rotational speed of the vertical blade rotary rejector and the infeed rate of raw material into the primary cyclone separator. U.S. Pat. No. 4,963,634 discloses an air flow into the primary cyclone separator at a fan rotational speed of 3,900 RPM (revolutions per minute) and a rotor rotational speed of approximately 900 RPM to effect the desired separation of fine-sized polyvinyl chloride particles.

The use of dynamic air cyclone separators, as disclosed in U.S. Pat. No. 4,963,634, is not directly applicable to the segregation of rendered animal meals. The components of animal feed meals made from rendered animal by-products do not have the wide disparity of size and density as is present in the mineral, vegetable meal and plastic resin infeeds, for which these separators have been used by the prior art. For example, when it was attempted to use the cyclone separator disclosed in U.S. Pat. No. 4,257,880 for the recovery of a low ash fraction from rendered animal meals, following the teachings of U.S. Pat. No. 4,963,634, disappointingly low yields of low ash material were obtained. Specifically, low ash yields of from 25 to 32% by weight were obtained from a rendered animal by-product infeed at an air inflow fan RPM of about 3,100, and at rotary rejector speeds of about 700 RPM.

Accordingly, there is need for an improved process to separate the low ash fraction of rendered animal meals over the prior art air separation means, which does not suffer from low yield and is accordingly more economical and efficient.

SUMMARY OF THE INVENTION

The disadvantages that have characterized the prior art are substantially overcome through the practice of the present invention, which unexpectedly provides a method of separating at least 50% by weight of the low ash fraction, from the substantially similarly sized high ash fraction, of finely divided rendered animal meal infeeds. The low ash fraction is segregated using the double air vortex generated in a dynamic air cyclone separator equipped with a vertical blade rejector, whereby the rotational speed of the rejector is maintained at a maximum of about 300 RPM.

The air cyclone separator used in the practice of the present invention is an air classification system comprised of a primary air classifier having an upper main classifying chamber in communication with a lower expansion chamber. Superatmospheric pressure air is tangentially fed to the lower expansion chamber, creating a descending air vortex along the chamber outer wall. Concomitantly, the superatmospheric tangential air feed creates a central, axially rising spire of air which enters the upper main classifying chamber. The upper main classifying chamber is provided with a spinning cylindrical rotary rejector fan proximate to an air exit port near the chamber apex. The rotary rejector fan is supported for rotation about a vertical axis and is equipped with vertical blades located along the fan circumference. Each blade lies in a radial plane from the fans vertical axis. By operating the rotary rejector at a rotational speed of from about 75 to about 300 RPM, yields of at least 50% by weight or more of low ash material are obtained. The low rotary rejector efficiency, created by the low rotary rejector rotational speeds is critical to the high yields of low ash fraction obtained. The use of relatively wide spacing between the vertical blades on the circumference of the rotary rejector fan further enhances the high yields of low ash fraction. In the practice of the instant invention, the spacing maintained from blade longitudinal center to blade longitudinal center is at least 2.5% of the circumference of the rotary rejector and preferably about 3.5% to 5% of the circumference.

In operation, an infeed of rendered animal meal is delivered to the upper main classifying chamber of the primary air classifier, into the axially rising spire of air. The low ash fraction of meal is entrained within the axially rising air spire and carried by the rising air spire through the rotary rejector into the air exit port near the chamber apex communicating with a second air classifier; wherein, the low ash fraction is removed from the entraining air and is recovered. The higher ash fraction passes downward from the main classifying chamber into the expansion chamber by force of gravity and is then driven to a lower exit by the descending air vortex.

DETAILED DESCRIPTION OF INVENTION

Figure 1:
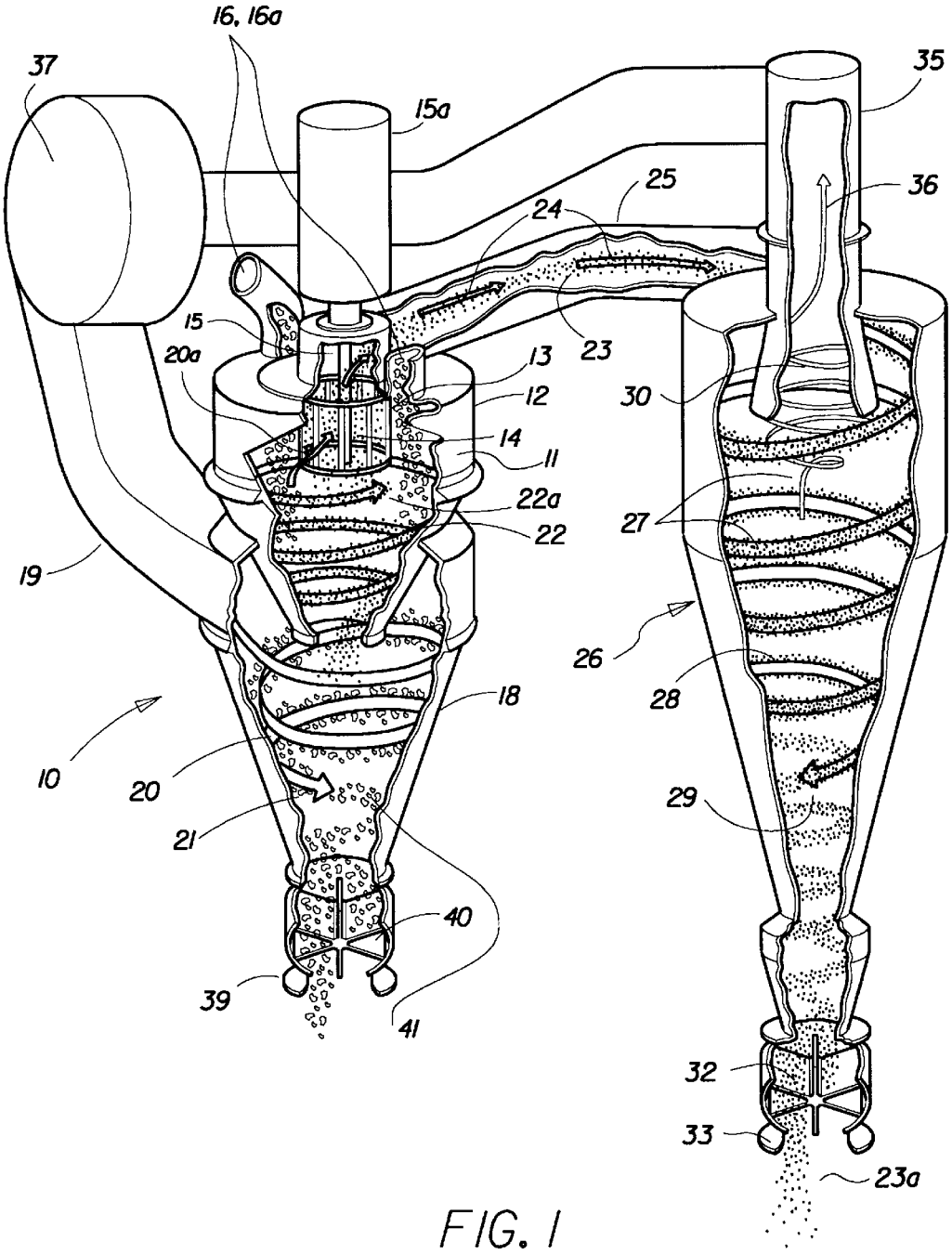
FIG. 1 is an isometric view of the air cyclone separator, embodying the present invention.

Referring now to FIG. 1, there is illustrated an air cyclone device for practicing the process of the present invention. As illustrated, the invention comprises a primary air classifier, 10, having a main classifying chamber, 11, which contains within its upper section, 12, a rotary particle rejector, 13, having a plurality of vertical blades, 14, which are preferably tapered from top to bottom in depth. The rotary particle rejector, 13, is mounted on a vertical axis, 15, connected to a drive means, 15*a*. The main classifying chamber, 11, is provided with a plurality of infeed ports, 16, 16*a*, through which the rendered animal meal comprised of particles having similar sizes, but differing densities is introduced into the chamber, 11. Air at superatmospheric pressure is introduced into an expansion chamber, 18, having a continuous conically shaped wall and located below and in communication with the main classifying chamber, 11. The air enters the expansion chamber, 18, through an air infeed duct, 19. The air is introduced at a tangent to the conical wall of the expansion chamber, 18, forming a spiral cyclone of air, 20, descending in the direction indicated by the arrow, 21, along the wall of the expansion chamber, 18. Concomitant with the creation of the descending spiral cyclone of air, 20, an upwardly rising spire of air is created, 22, which rises in the direction indicated by the arrow, 22*a*. The spire of air, 22, caused by the cyclone double vortex effect is within and axially central to the descending spiral cyclone, 20. This upwardly rising spire of air, 20, entrains and carries to the rotary particle rejector, 13, in the direction of the arrow 20*a*, the lower density, low ash fraction of the rendered animal meal infeed. The rotary particle rejector, 13, further classifies the low ash fraction of the rendered animal meal; this further classified low ash fraction, 23, being carried away in the direction indicated by the arrows, 24, in a take-away duct, 25, which is in communication with and forms the infeed to a secondary cyclone air cleaning separator, 26. The secondary cyclone air cleaning separator, 26, separates the low ash fraction, 23, from the air in which it is entrained. The infeed air delivered to the secondary cyclone air cleaning separator, 26, through the take-away duct, 25, is of a pressure sufficiently elevated to create a double vortex cyclone, 27, within the separator, 26. The double vortex cyclone has a descending vortex component, 28, and central thereto a rising air spire, 30, which rises within the separator, 26. The descending vortex component, 28, is proximate to the wall of the secondary cyclone air cleaning separator, 26, and in the direction of the arrow 29. The air entrained low ash fraction, 23, which has entered the secondary cyclone air cleaning separator, 26, is carried by the descending vortex, 28, to an air lock means, 32, shown as a rotary air lock positioned proximate to the bottom, 33, of the separator, 26; wherein, the low ash fraction, 23*a*, is separated from the entrained air and collected by means not shown. The clean air separated from the entrained low ash fraction, 23, spirals up and out of the separator, 26, through an upper exit duct, 35, in the direction indicated by arrow 36. This clean air is recycled using an external high speed fan, 37, as the superatmospheric infeed air to the expansion chamber, 18, via the air infeed duct, 19. The high ash fraction, 41, of the rendered animal meal, stripped of the low ash fraction, 23*a*, is carried downward by the descending spiral cyclone of air, 20, to the base, 39, of the expansion chamber, 18, and recovered using air lock means, 40, shown as a rotary air lock positioned proximate to the bottom, 39, of the primary air classifier, 10.

In the practice of the present invention, it has been determined that the effectiveness in achieving particle separation is dependent on the efficiency of the rotary rejector (the rotor). The efficiency of the rotor is a function of the rotor's speed as measured in RPM and the total lateral surface area of the rotor's blades, i.e., the sum of the areas of each blade's front face, the face within the radial plane from the center of the rotary rejector facing in the direction of rotation of the rotor. The total lateral surface area of the rotor's blades is a function of the number of blades, as limited by the circumference of the rotary rejector and the spacing from one blade to the next. Given fixed size blades and a fixed rotor diameter, the variable determining the total lateral surface area of the rotor's blades is the spacing from one rotary rejector blade to the next.

To maximize the yield of the low ash fraction of rendered animal meal, the efficiency of the rotor must be minimized. This is accomplished by maintaining a substantial spacing between each rotor blade, as differentiated from the typical spacing used in mineral and plastic particle cyclone separators of the type disclosed in U.S. Pat. No. 4,257,880 and U.S. Pat. No. 4,963,634, i.e., minimizing the total lateral surface area. In the present invention, a minimum spacing of at least 2.5% of the circumference of the rotary rejector from blade longitudinal center to blade longitudinal center is necessary, preferably about 3.5 to 4.0% is advisable. This spacing is based upon a 24 inch diameter rotary rejector, any scaling up or down in rotary rejector diameter will require nominal adjustments to optimize recovery of the desired material. Further, a relatively low rotor speed in RPM in the range of about 75 to about 300 RPM, or more preferably in the range of about 90 to about 150 RPM, or most preferably in the range of about 95 to about 10 RPM to obtain maximum recovery of a low ash segment from the infeed rendered animal meal. These relatively low rotor speeds in RPM are as distinguished from the use of rotor speed of 400 to about 2,000 RPM conventionally used in air classification processes of the type disclosed in U.S. Pat. Nos. 4,257,880 and 4,963,634. An example of such commercially available air classification units designed for operation at rotor speeds of from 400 to about 2,000 RPM is the Micro-Sizer line of air classifiers manufactured by Progressive Industries, Inc. of Sylacauga, Ala.

Micro-Sizer air classifiers available under the designation MS-5's and MS-20's are normally operated at a rotor RPM range of from about 400 to 2,000 RPM, to obtain the particle separation with mineral and plastic resin materials. Further, the mid-sized MS-20 unit, designed for a maximum 20 tons per hour throughput, is normally equipped with a 24 inch diameter rotary rejector having about 56 equally spaced blades about its circumference, with a total radial plane blade surface area of about 1,260 square inches. At the most preferred 3.6% of the rotary rejector circumference blade spacing, the rotary rejector will be limited to 28 blades about its circumference, with a total radial plane blade surface area of 630 square inches.

In addition to using slow rotational speeds and wide spacing of the vertical blades of the rotary rejector to minimize the efficiency of the air classifier to obtain maximum low ash yields, further yield enhancement is obtained by adjusting the infeed rate of rendered animal meal to the commercial unit to be near the lower end of the commercial unit's design capacity. For example, a MS-20 air classifier which has a design capacity of from 1 to 20 tons/hour, must be operated at less than about5 tons/hour and preferably at less than about 4 tons/hours and most preferably at less than about 3 tons per hour, or from about15 to about 25% of the design capacity.

The air entering the expansion chamber, 18, as driven by the external high speed fan, 37, should be at superatmospheric pressures created by rotational speeds of the external high speed fan from about 2,800 to about 3,500 RPM. Preferably, the external high speed fan rotation should be from about 3,000 to about 3,200 RPM.

The invention will be better understood by reference to the following example. This example exemplifies the operation of the subject invention; but, does not limit its scope in any way.

EXAMPLE 1

A commercial Progressive MS-20 air classifier modified to the construction of the embodiment shown in FIG. 1 was used to classify feed from animal by-products to recover low ash meal. The MS-20 had a design infeed capacity of from 1 to 20 tons/hour, and was equipped with a 24 inch diameter rotary particle rejector, 13, designed to function at a rotational speed in a range of from 400 to about 2,000 RPM, with a set of 56 equidistant, vertical, 0.1857 inch thick rejector blades arranged along its perimeter, each blade being positioned radially with respect to the vertical axis of the rotary particle rejector and spaced about 1.8% of the circumference apart.

To modify the MS-20 unit for the practice of the process of the present invention every other of the original 56 rotary rejector blades was removed, leaving a set of 28 equidistant blades, spaced about 2.7 inches, or 3.57% of the rotary rejector circumference, from blade longitudinal center to blade longitudinal center around the perimeter of the rotary rejector, 13. The infeed rate of rendered animal meal fed to the infeed ports, 16, 16*a*, was held to less than 18% of the design maximum of the MS-20, or about 3.5 tons per hour. The MS-20 was run at varying rotary rejector speed rates, in the range of 100 to 300 RPM, to obtain commercially acceptable yields e.g. at least a 50% yield of low ash material. The external high speed fan, 37, was run at a rotational speed of about 3,100 RPM.

For purposes of comparison, the procedure of Example 1 was repeated except that the rotational speed of the rotary rejector, 13, was varied from 400 to 700 RPM. The results recorded in Table I, below, indicate that the commercially acceptable yields of the low ash fraction, in the range of 54.5 to 76.5% by weight, were obtained at rotary rejector speed rates of from 100 to 300 RPM. Whereas, yields of the low ash fraction obtained at rejector rotor speeds of from 400 to 700 RPM, were substantially less than 50% by weight of the total infeed rendered animal by-product meal.

TABLE I

| Rotor RPM | Ash Content in Yield (% by Weight) | Yield of Low Ash (% by Weight) |
|---|---|---|
| 100 | 11.0 | 76.5 |
| 125 | 10.9 | 73.7 |
| 150 | 11.0 | 71.0 |
| 175 | 11.0 | 68.2 |
| 200 | 11.0 | 65.3 |
| 300 | 10.7 | 54.5 |
| 400 | 10.1 | 45.0 |
| 500 | 9.8 | 37.4 |
| 600 | 9.6 | 31.9 |
| 700 | 9.6 | 28.2 |

I claim:

1. A method of separating the substantially similarly sized high and low ash fractions of rendered animal meal to obtain yields of the low ash fraction greater than about 50% by weight, wherein the low ash fraction contains less than about 11% by weight ash, the method comprising:

(a) introducing to a primary air cyclone separator a rendered animal meal, the primary air cyclone separator having: (i) a chamber provided with means to create a double air vortex, the double vortex including a first axially downward air vortex proximate to the chamber walls and a second axially upward air vortex located central to the first axially downward air vortex; and (ii) a rotary particle rejector supported for rotation about a vertical axis, the rotary particle rejector being equipped with a set of blades radially aligned vertically along the rotary particle rejector perimeter and wherein the spacing from blade longitudinal center to blade longitudinal center is at least about 2.5% of the rotary particle rejector circumference;

(b) operating the rotary particle rejector at a rotational speed between about 75 and about 300 rotations per minute;

(c) entraining the low ash fraction in the upward air vortex;

(d) passing the air entrained low ash particles to a secondary air separator means to recover the low ash fraction; and (e) recovering means to recover the high ash balance of the rendered animal meal from the primary air cyclone separator.

2. A method according to claim 1, wherein operating of the rotary particle rejector is operated at a rotational speed between about 75 and about 150 rotations per minute.

3. A method according to claim 1, wherein the spacing of the rotary particle rejector blades is from about 3.5% to about 5% of the rotary particle rejector circumference.

4. A method according to claim 3, wherein operating of the rotary particle rejector is at a rotational speed between about 95 and 110 rotations per minute.

* * * * *